US007051411B2

(12) United States Patent
Liu

(10) Patent No.: US 7,051,411 B2
(45) Date of Patent: May 30, 2006

(54) APPARATUS FOR RIVETER

(76) Inventor: Pao-Fang Liu, No. 7, Lane 4, Kuangshan, ShinCheng, Guangshang Village, Sanyi Township, Miaoli Country (TW)

( * ) Notice: Subject to any disclaimer, the term of this patent is extended or adjusted under 35 U.S.C. 154(b) by 44 days.

(21) Appl. No.: 10/714,653

(22) Filed: Nov. 18, 2003

(65) Prior Publication Data

US 2005/0022575 A1 Feb. 3, 2005

(30) Foreign Application Priority Data

Aug. 1, 2003 (TW) ..... 92121089 A

(51) Int. Cl.
*B21J 15/38* (2006.01)
*B21J 15/04* (2006.01)
*B21D 31/00* (2006.01)

(52) U.S. Cl. ..... 29/243.527; 29/243.521; 72/391.4

(58) Field of Classification Search ..... 72/409.12, 72/391.4, 391.8; 29/243.526, 243.527, 243.523
See application file for complete search history.

(56) References Cited

U.S. PATENT DOCUMENTS 2,399,442 A * 4/1946 Luce ..... 72/391.8
3,760,627 A * 9/1973 Richardson et al. ... 29/243.527
4,653,308 A * 3/1987 Gregory ..... 72/409.12
5,359,762 A * 11/1994 Liu ..... 72/391.4
5,367,757 A * 11/1994 Liu ..... 29/243.527

* cited by examiner

*Primary Examiner*—David B. Jones
(74) *Attorney, Agent, or Firm*—Rosenberg, Klein & Lee

(57) ABSTRACT

A riveter apparatus includes a body, a handle part and a pulling part. The body further includes a base and a front tube. The base interior has a column with an adjustable groove that has a greater diameter in the front end than the back end. The base also has a slot through the adjustable groove into the front end connects to the column. The handle part that connects to two ends of the base includes a pair of outside-arms, inside-arms, holders and push-arms with a perforation in the middle. The pulling part which is extends through the base and the front tube of the body includes an adjustable nut, an adjustable shaft and a rod. The adjustable nut is axially displaceable and secured against rotation. The adjustable shaft extends through the middle perforation of the push-arms and the adjustable nut, with a front thread which is screwed to the thread of the adjustable nut.

9 Claims, 5 Drawing Sheets

APPARATUS FOR RIVETER

BACKGROUND OF THE INVENTION

1. Field of the Invention

The present invention relates in general to an adjustable riveter apparatus for pulling a screw column, and more particularly, to control a length of the screw column for different screws.

2. Description of the Related Art

The riveter apparatus is a very common tool at a construction site for a pulling screw column. The riveter apparatus makes a position head by pulling a plate, than uses a column to connect to a front end of a rod of the riveter apparatus, through a hole on a board. While pressing a handle of the riveter apparatus, the rod will back and change the column shape so as to fix it to the board. The changed column is the result of the rod dragging force and the column backing force, so the distance of dragging is relative to the quality of the riveter apparatus. Further, if the rod dragging force is too large and deforms the column more than needed, the column will be destroyed under the handle pressing force and affect the quality of construction. It is also a problem where the rod dragging force is too small to adequately deform the column, the column is not effective. In the past, the riveter apparatus can not be adjusted for pulling distance, so the handle of riveter apparatus must be pressed until the optimal distance is achieved. That results in the column being easily destroyed, and requires rework. In order to solve the above problem and save working time, the present invention provides an adjustable riveter apparatus for adjusting the displacement distance of the column so as to improve the quality of construction and prevent the column from being destroyed.

SUMMARY OF THE INVENTION

It is an object of this invention to provide a riveter apparatus for adjusting a screw column and easy control of the pulling force. Further, it is an object to achieve high quality construction with the riveter apparatus.

It is another object of this invention to provide a riveter apparatus for adapting to different construction conditions to prevent the column thread from being destroyed.

It is still another object of this invention to provide a riveter apparatus for precise control of the column distance.

It is to be understood that both the foregoing general description and the following detailed description are exemplary and explanatory only and are not restrictive of the invention, as claimed

DESCRIPTION OF THE PREFERRED EMBODIMENTS

Figure 1:
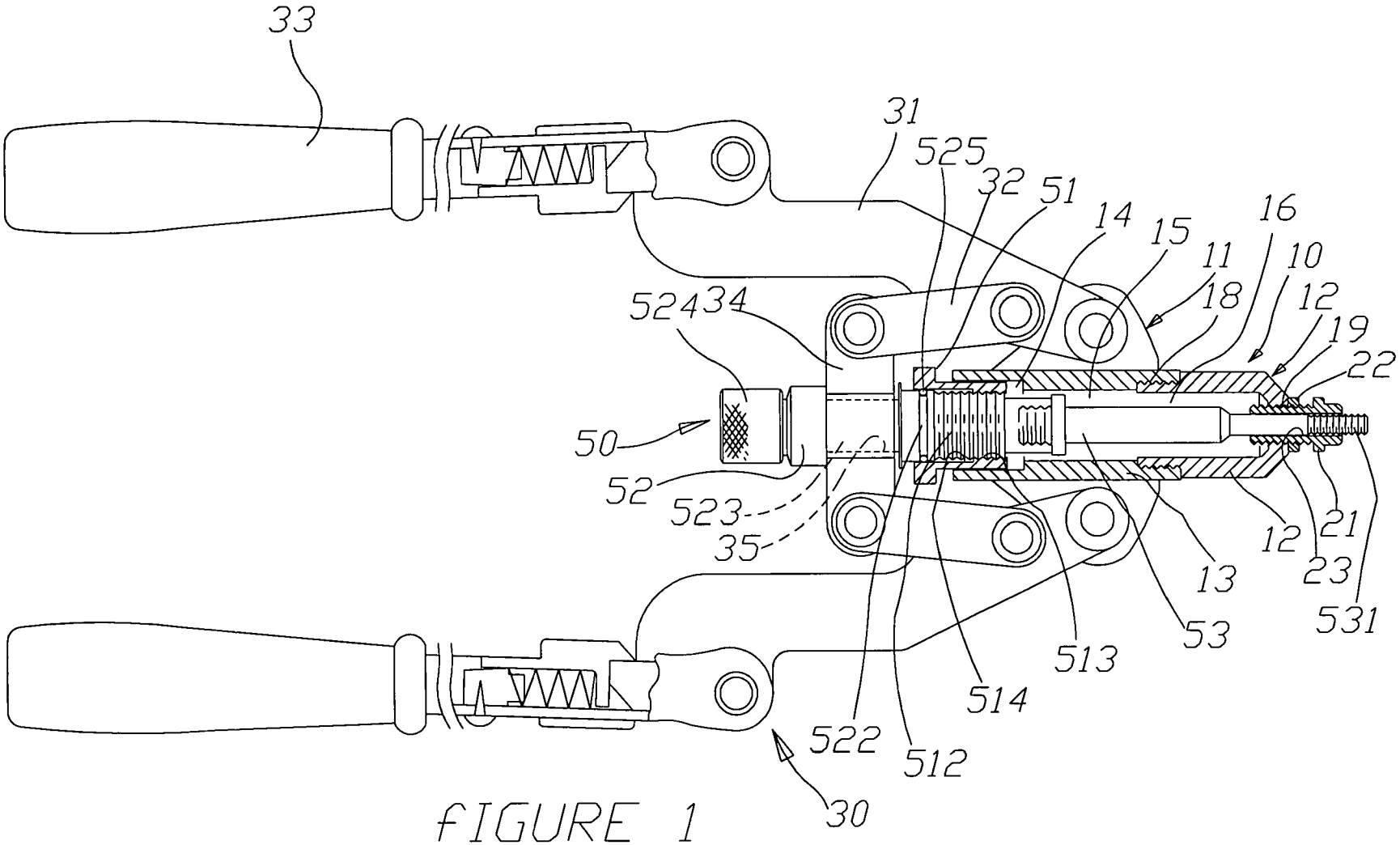
FIG. 1 is a partial cross-sectional view of the riveter apparatus of the present invention.
Figure 2:
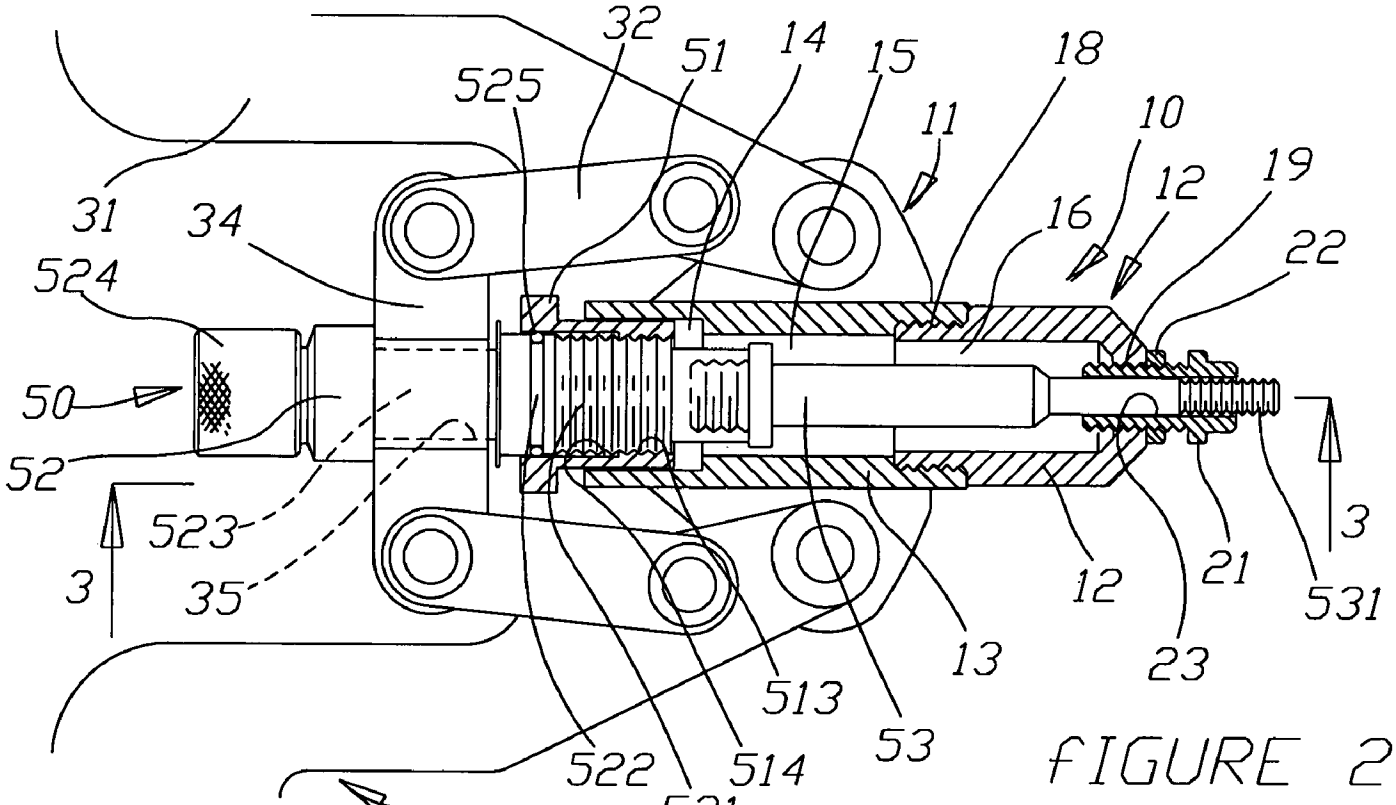
FIG. 2 is a partial cross-sectional view of a portion of the present invention.
Figure 3:
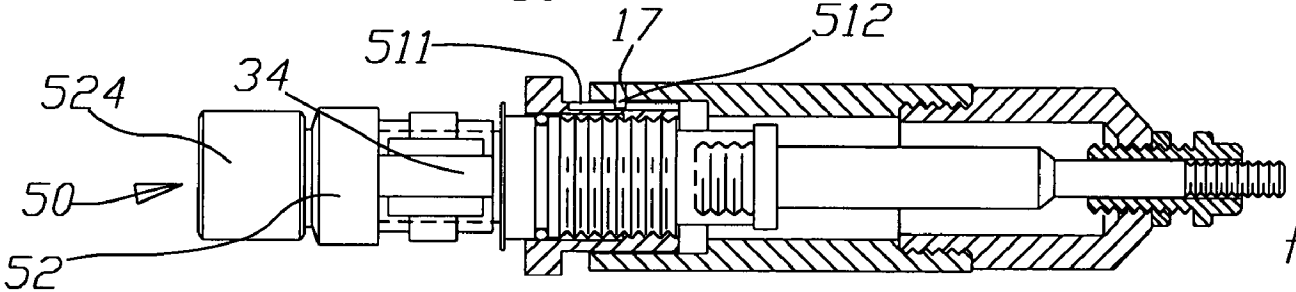
FIG. 3 is a partial cross-sectional view of a rod of the present invention.

Referring to FIGS. 1, 2 and 3, the present invention includes a body 10, a holding part 30 and a pulling part 50. The body 10 has a base 11 and a front tube 12. There is a column 13 inside the base 11. The column 13 further has an adjustable groove 14 with large diameter in end of the adjustable groove 14, a cylindrical portion 15 with a smaller diameter in the middle of the tube, and a chamfer 16 with front thread. In the end of the base 11, there is a slot 17 extending through the adjustable groove 14, as shown in FIG. 3. The front tube 12 is hollow-shaped. There is a threaded part 18 in one end of the front tube 12, so as to spin along the screw into the chamfer 16 of the column 13. An opening 19 is formed in the front end of the front tube 12, and there is a bolt 21 and a cap 22 on top of the bolt 21 that are fixed in the opening 19 of the front tube 12. The bolt also has a channel 23 formed therethrough.

The holding part includes a pair of outside-arms 31, inside-arms 32, handles 33 and push arms 34. The outside-arms 31 connect to two sides of the body 11, respectively. The inside-arms 32 connect to the end of outside-arms 31, respectively, and the push-arms 34 connect to the end of inside-arm 32. Each of portions of the holding part are linked together to move. Furthermore, a perforation 35 is formed in the middle of the push-arms 34.

The pulling part 50 extends through the inside of the base 11 and front tube 12 of the body 10. The pulling part 50 includes an adjustable nut 51, and an adjustable rod 53. The adjustable nut 51 is positioned on the adjustable groove 14 of the column 13. Outside the column, there is a notch 511, as FIG. 3 shows. The notch 511 will receive a shaft 512 that can be extended through the slot 17 of the body 11. When the shaft 512 extends through the slot 17 of the body 11 to be disposed in the notch 511, the adjustable nut 51 in the adjustable hole 14 only can move along axially and cannot rotate. Inside the adjustable nut 51, the front end thereof has a small thread 513, and the back end has a bigger diameter centrally disposed axial bore 514. Furthermore, on the outside of the adjustable nut 51, there is a scale for precise adjusting of the length. The adjustable rod 52 extends through the push arm 34 and the adjustable nut 51, which includes a front thread 521, a recess 522 and a pattern end 524. The front thread 521 connects to the screw section 513 of adjustable nut 51. The recess 522 has a space for placing a washer 525 so as to provide accurate adjust and avoid slipping. The stopping channel 523 extends through the perforation 35 of the push-arms 34 that makes the push-arms 34 to fix on the stopping channel 523, so the adjustable rod 52 can be rotatively operated to revolve. The end 524 has a pattern formed therein that aids a user to rotate the adjustable rod 52. Further, the front end of adjustable rod 52 has a screw hole to turn to the rod 53. The front end of rod 53 passes is through the bolt 21 and has another screw section 531, which is threaded into the screw tube for constructing pulling work.

Figure 4:
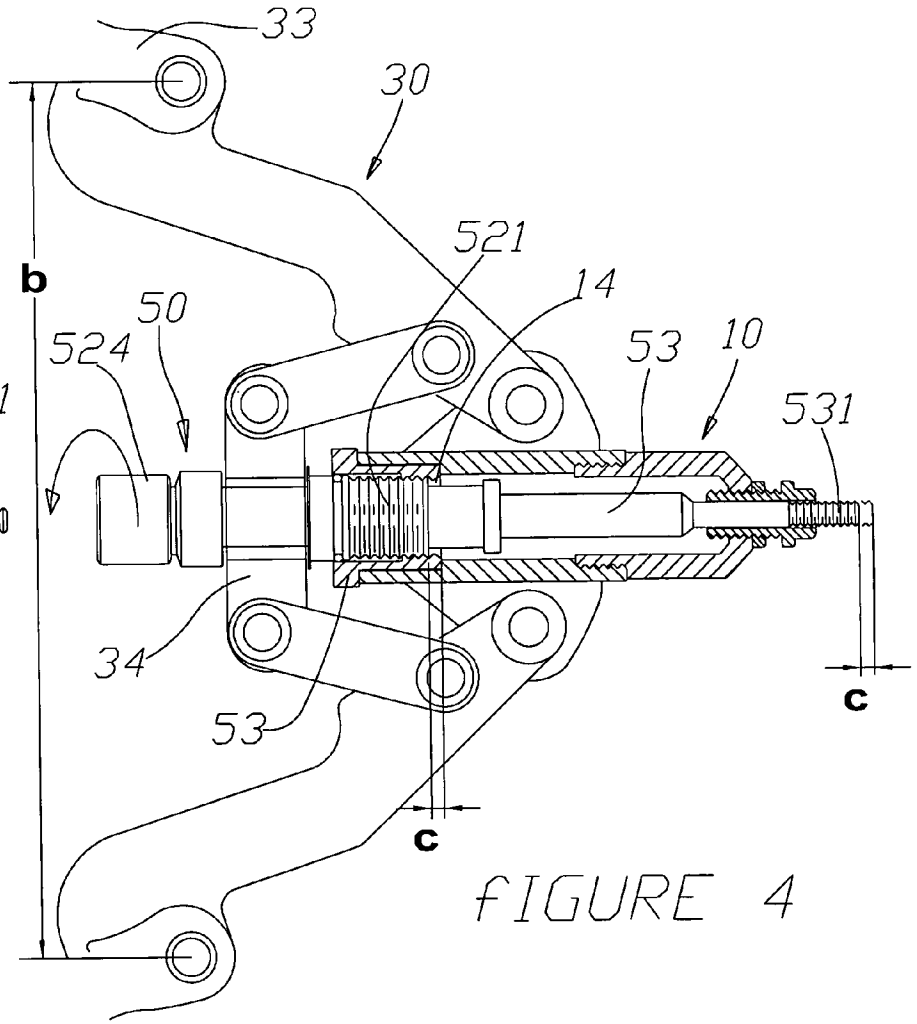
FIGS. 4 and 5 are illustrations showing adjustment of the riveter apparatus of the present invention.
Figure 5:
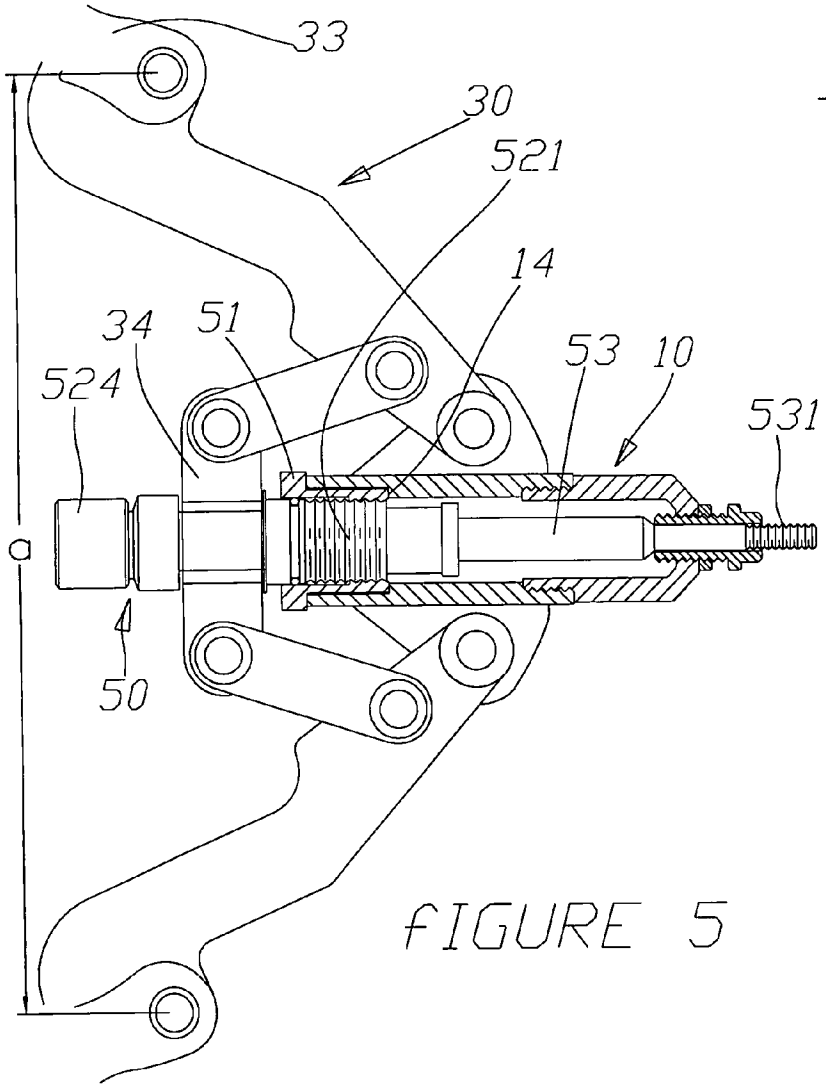

Referring to FIGS. 4 and 5, there is shown, the adjusting process for adjusting the pulling distance in present invention. In FIG. 4, while the holder is opened, the push-arms 34 impels the pulling part 50 to the front till the adjustable nut 51 touch the end of adjustable channel 14 to stop, which is the limit distance, b, of the holder 33. While turning the patterned end 524 of adjustable rod 52, the adjustable nut 51 is impelled to a displacement, c, that is opposite to the adjustable rod 52. As the end of adjustable nut 51 and adjustable channel 14 has been adjusted a displacement, c, the holder 33 also can be expanded a distance greater than displacement a, and the pulling part 50 can be impelled a distance more than displacement b by push-arms 34, as shown on FIG. 5. So, if the holder 33 opens a greater distance or greater degree, the pulling part 50 and the screw section 531 will protrude. As described above, pressuring the holder 33 to operate the pulling process, the pulling part 50 could be backed out a greater distance so as to provide a greater adjusting space. To reduce the distance in the pulling process, which can reverse the operation of adjustable nut 51 and adjustable rod 52 as described above.

Figure 6:
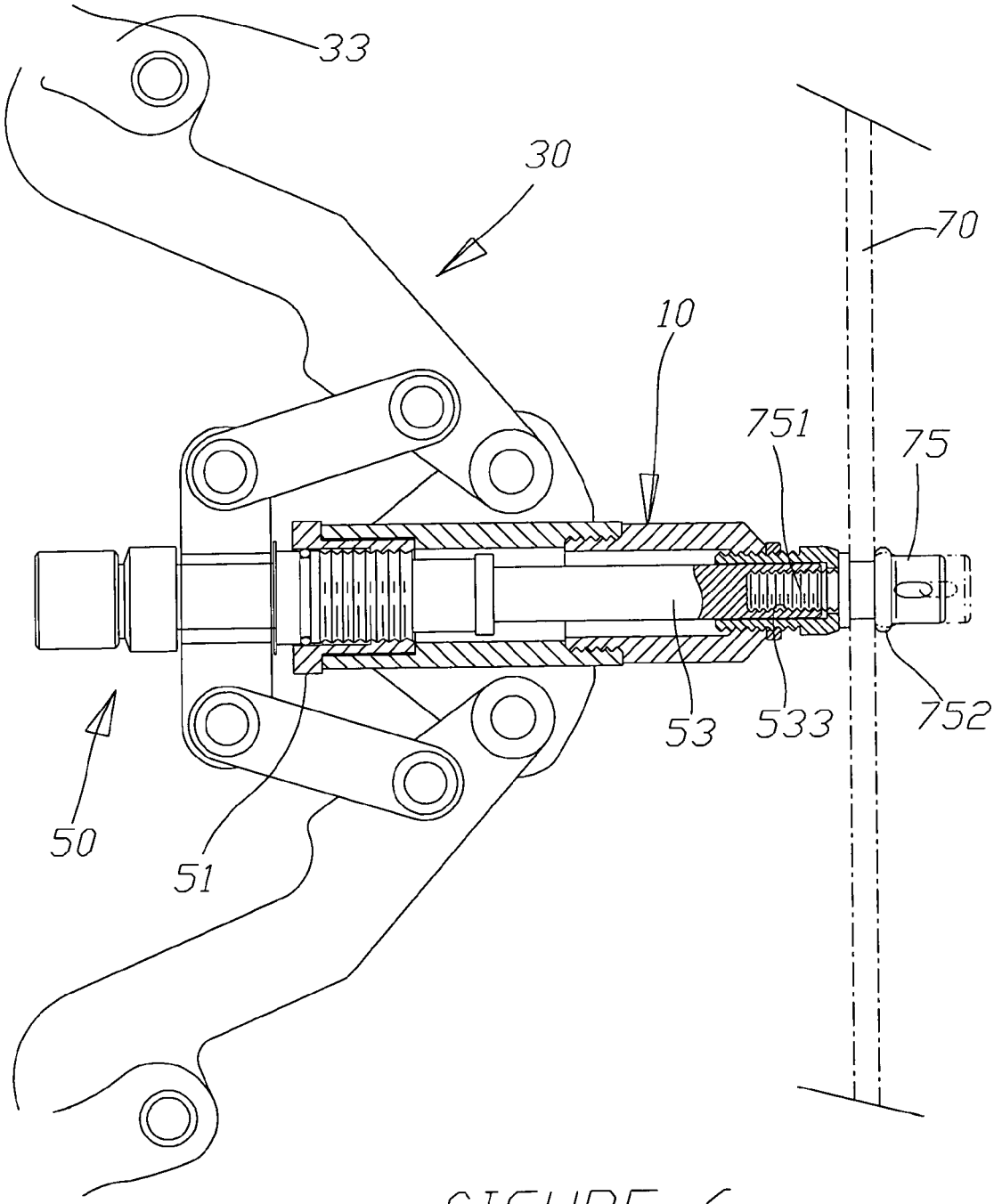
FIG. 6 is an illustration of operation of the riveter apparatus of the present invention adapted for a different type of fastener.
Figure 7:
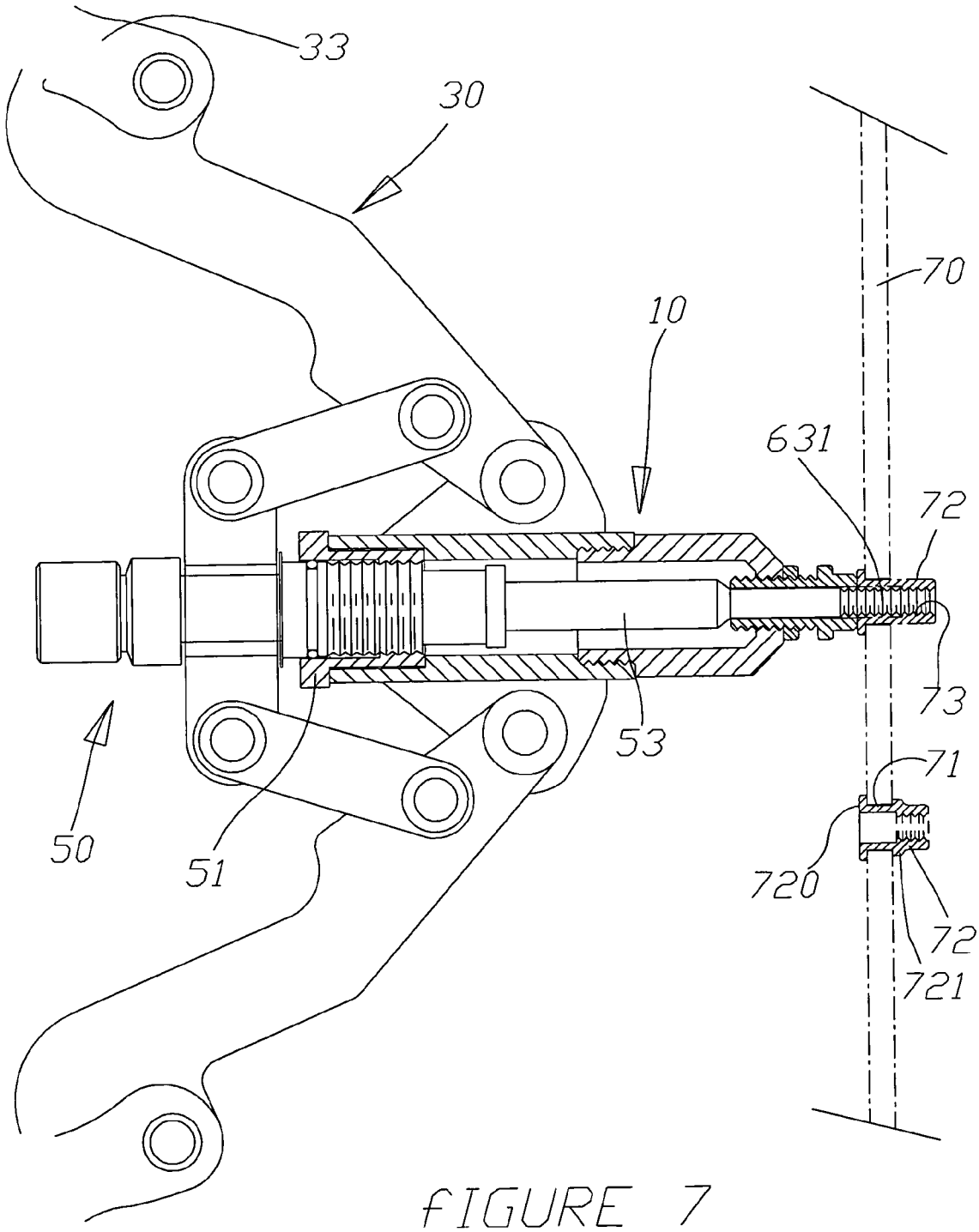
FIG. 7 is an illustration of operation of the riveter apparatus of the present invention.

Next, with reference to FIG. 7, in the operation of the present invention, the first step is to connect the thread 531 of the end of pulling part 50 to the screw tube 75 through a perforation 71 of an operating board 70. At the same time, pressing the holder 33 of riveter apparatus makes the pulling part 50 move back to pull so the screw tube 75, which changes its shape 721 and is thereby fixed on the operating board 70. Referring to FIG. 6, the riveter apparatus is adapted for a fastener of a different shape.

Instead of an internally threaded screw tube 75, the fastener has a screw rod 751. The rod 53 connects to the front end of pulling part 751 and is constructed with an inner screw section. By connection to this inner screw section 533 and the screw rod 751 in the front end of screw tube 75, the riveter operation causes the distortion 752 of screw tube 75.

As mentioned above, this invention is directed to the design of the adjustment of adjustable nut 51 and the screw connection of adjustable nut with the adjustable shaft 52 of pulling part 50. If the screw cap 51 is adjusted, there can be made a lateral motion by a cross-linked reaction of pulling part 50. The quality of the riveter process can be improved by the adjustment of pulling force and movement. And there is a fine scale apparatus on the adjustable nut 51. The adjustment can be accurately controlled by adjusting the moving quantities read out by the scale apparatus. Finally, accurate operation and quality of pulling cap can be obtained.

Other embodiments of the invention will appear to those skilled in the art from consideration of the specification and practice of the invention disclosed herein. It is intended that the specification and examples to be considered as exemplary only, with the true scope and spirit of the invention being indicated by the following claims.

What is claimed is:

1. An apparatus for riveter, comprising:

a body including a base and a front tube, the base having an interior with a column having an adjustable groove, the base having a slot formed through the adjustable groove, the front tube being connected to the column;

a handle part connected to two ends of the base, the handle part including a pair of outside-arms, inside-arms, holders and push-arms, the push-arms having a perforation formed in a middle portion thereof; and a pulling part extending through the base and the front tube of the body, the pulling part including an adjustable nut, an adjustable shaft and a rod, the adjustable nut having a notch formed on an outside thereof and disposed in the adjustable groove of the base, the notch receiving a shaft extending through a slot of the base, an interior of a front end the adjustable nut having a thread formed therein; wherein the adjustable shaft extends through the middle perforation of the push-arms and the adjustable nut, the adjustable shaft having a front thread screwed to the thread of the adjustable nut, the rod having a front end extending through the front tube.

2. The riveter apparatus of claim 1, wherein the font end of the front tube has an opening having a bolt that has a cap thereon and a channel formed therethrough.

3. The riveter apparatus of claim 1, wherein the outside-arms connect to the two ends of base, the inside-arms connect to a front end of outside-arms, and the holder respectively connects to an end of a pairs of inside-arms that are cross-linked to move.

4. The riveter apparatus of claim 1, wherein a back end of the adjustable nut has an axial hole with a greater inside diameter than a diameter of the thread formed in the front end thereof.

5. The riveter apparatus of claim 1, wherein the adjustable nut has a recess for receiving a washer.

6. The riveter apparatus of claim 1, wherein the adjustable rod has a stop channel that is formed to extend through the middle perforation of the push-arms.

7. The riveter apparatus of claim 1, wherein the adjustable shaft has a back end with a pattern formed therein.

8. The riveter apparatus of claim 1, wherein the adjustable shaft has a front end with an interior spiral-hole to screw the rod therein.

9. The riveter apparatus of claim 1, wherein the front end of rod has a thread.

* * * * *